United States Patent [19]

Hotta et al.

[11] Patent Number: 4,814,588

[45] Date of Patent: Mar. 21, 1989

[54] FOODSTUFFS HEATING APPARATUS USING INFORMATION CARDS FOR AUTOMATIC MODE SETTING OR THE LIKE

[75] Inventors: Kouichi Hotta, Yachiyo; Yukichi Yazawa, Kashiwa; Osami Tatsukawa, Matsudo, all of Japan

[73] Assignee: Hitachi Heating Appliances Co., Ltd., Chiba, Japan

[21] Appl. No.: 256,539

[22] Filed: Apr. 22, 1981

[30] Foreign Application Priority Data

| | | | |
|---|---|---|---|
| May 12, 1980 | [JP] | Japan | 55-64672[U] |
| May 15, 1980 | [JP] | Japan | 55-64375 |
| May 15, 1980 | [JP] | Japan | 55-66499[U] |
| May 29, 1980 | [JP] | Japan | 55-71844 |
| May 29, 1980 | [JP] | Japan | 55-71845 |
| Jul. 19, 1980 | [JP] | Japan | 55-98995 |

[51] Int. Cl.[4] ..... H05B 1/02

[52] U.S. Cl. ..... 219/10.55 B; 219/506; 219/492; 235/445

[58] Field of Search ..... 219/493, 492, 497, 502, 219/10.55 B; 200/46; 235/435, 445, 444, 489

[56] References Cited

U.S. PATENT DOCUMENTS

| | | | |
|---|---|---|---|
| 4,158,432 | 6/1979 | Van Bavel | 219/10.55 B |
| 4,245,148 | 1/1981 | Gisske et al. | 219/502 |
| 4,297,568 | 10/1981 | Okatsuka | 200/46 |

FOREIGN PATENT DOCUMENTS

| | | | |
|---|---|---|---|
| 0002743 | 1/1978 | Japan | 219/10.55 B |
| 0049627 | 4/1980 | Japan | 219/10.55 B |

*Primary Examiner*—M. H. Paschall

*Attorney, Agent, or Firm*—Antonelli, Terry & Wands

[57] ABSTRACT

There is disclosed a card type foodstuffs heating apparatus with a plurality of differnt heating modes in which at least one desired heating mode is selected from the plurality of heating modes by means of one card selected in use from a plurality of different cards.

Each of the different cards carries main information for instructing the selection of at least one heating mode required for a desired cooking from the plurality of heating modes, and additional information for instructing at least one additional heating conditions determined dependent on the specified heating mode. The apparatus has setters for setting the additional heating conditions in accordance with the additional information carried by a selected card, and a heating operation controller for actuating the specified heating mode in accordance with the main information carried by the selected card so as to effect the heating operation under the set additional heating condition.

23 Claims, 6 Drawing Sheets

FOODSTUFFS HEATING APPARATUS USING INFORMATION CARDS FOR AUTOMATIC MODE SETTING OR THE LIKE

This invention realtes to a foodstuffs heating apparatus and more particularly to a foodstuffs heating apparatus of the type having a plurality of heating modes, thereby at least one desired heating mode can be selected by setting a cooking card into an operation panel. This type will be hereinafter referred to as a card type heating apparatus.

Inventors of the present application have been devoting themselves to the search and development of card type foodstuffs heating apparatus. With a card type foodstuffs heating apparatus which has already been developed by the inventors, as will be described later, the heating mode is first selected by using a cooking card as mentioned above, and additional heating conditions which depend on the selected heating mode are then set manually. The additional heating condition is necessary for determining, for example, the degree of charring, heating temperature or heating time. In effect, a knob is turned manually for setting charring by referring to a cooking guide, for example, attached to the heating apparatus. However, the inventors have experienced in finding out that frequent reference to the cooking guide and setting an additional heating condition by turning the knob in accordance with instructions given in the guide upon use of the heating apparatus are rather troublesome and prone to cause inadvertent erroneous operations.

This invention contemplates to solve the problems set forth above.

According to a card type foodstuffs heating apparatus of the present invention, each of a plurality of cooking cards carries main information regarding the heating mode selection which is necessary for locating a heating mode in compliance with the name of cooking provided on the card, and additional information for instructing additional heating conditions. When a card is selected by naming a desired cooking and set into a predetermined position, a desired heating mode is automatically selected and set up in accordance with the main information. Additional heating conditions are manually set in accordance with the additional information.

The invention will be understood fully by reading the following detailed description of embodiments thereof taken in conjunction with the accompanying drawings, wherein.

In these figures, like elements are designated by like reference numerals/characters and description thereof is not repeated for simplicity.

Figure 1:
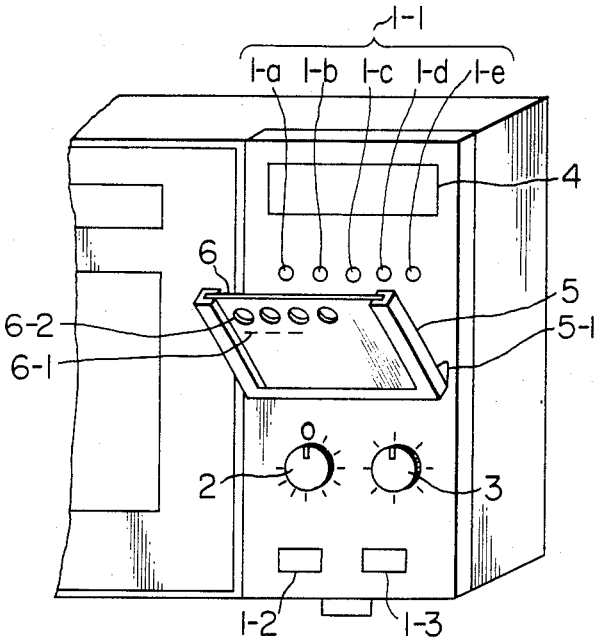
FIG. 1 is a fragmentary schematic perspective view showing an example of a card type foodstuffs heating apparatus developed by the inventors of the present application.
Figure 2:
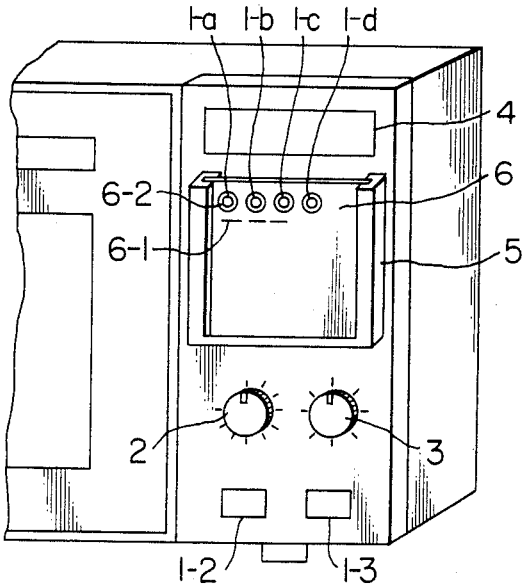
FIG. 2 is a similar view showing a card held in a predetermined position in the apparatus of FIG. 1.

Referring now to FIGS. 1 and 2, a card type foodstuffs heating apparatus developed by the inventors of the present application, from which the present invention starts, will first be described. The card type foodstuffs heating apparatus having major components as shown in FIGS. 1 and 2 is operable in selected one or more of a plurality of heating modes such as a strong heating by microwave energy, a weak heating by microwave energy, a steam heating, a grill heating, and an oven heating.

When heating or cooking foodstuffs with this card type foodstuffs heating apparatus, an intended cooking card 6 is selected from a number of cooking cards prepared beforehand by naming a cooking name 6-1 provided on the card. A card holder 5 hinged at a hinge 5-1 is then pulled forward as shown in FIG. 1, and the cooking card 6 of interest, formed with through holes 6-2, is set into the card holder 5. Subsequently, the card holder 5 is pushed back toward the apparatus body which is provided with a set of heating switches 1-1 consisting of, for example, a microwave energy strong heating mode selector switch 1-a, a microwave energy weak heating mode selector switch 1-b, a steam heating mode selector switch 1-c, a grill heating mode selector switch 1-d, and an oven heating mode selector switch 1-e which are arranged in line and in association with the respective through holes 6-2.

Accordingly, the cooking card 6 does not contact with some of the switches 1-1 because of the through holes 6-2 formed at portions of the card corresponding to these switches so that these switches are not actuated, but the remainder of the switches 1-1 in association with a part of the cooking card 6 at which no through holes 6-2 is formed may be depressed to be actuated by the card. Thus, in this example of FIGS. 1 and 2, the oven heating mode selector switch 1-e is actuated. In this way, the set of through holes 6-2 constitute the main information for selecting the desired heating mode.

To perform the oven heating mode as in the case of this example, it is necessary to set additional heating conditions such as a heating time and a heating temperature. Standard values of the time and temperature are described in a cooking guide attached to the apparatus and the user can consult given pages for these values.

Knobs 2 and 3 which serve as additional heating condition manual setters for setting the heating time and temperature are arranged below the card holder 5. These knobs 2 and 3 are set by referring to the aforementioned time value and temperature value. More specifically, as the knob 2 is turned, values for setting time corresponding to angular positions of the knob are displayed on an indicator 4 digitally and sequentially. The user is invited to monitor the displayed values so as to select a proper time approximate to the standard value in consideration of materials of the stuffs, water contained in the stuffs or user's preference. Thereafter, the knob 3 is turned for selection of a proper temperature approximate to the standard value in a similar manner.

Subsequently, a button of a heating start switch 1-3 is depressed to start the intended heating. In the event that contents thus set are found to be erroneous, the contents already set can be erased by depressing a cancellation switch 1-2.

In this manner, the setting of the contents of heating operations of the foodstuffs heating apparatus is completed. There are, however, the following disadvantages. Among the contents of heating, the heating mode dependent on the name of cooking can be set fully automatically by setting the selected cooking card into the card holder, but for manual setting of the additional heating conditions such as a heating time, a heating temperature and the like which have to be determined dependently on the selected heating mode, the user is troubled for consulting the attached cooking guide, etc., to know the standard values of the heating conditions. Disadvantageously, the user is doubly troubled for selecting the intended cooking card and for consulting the cooking guide and hence a complicated procedure is required for setting the contents of heating.

Figure 3:
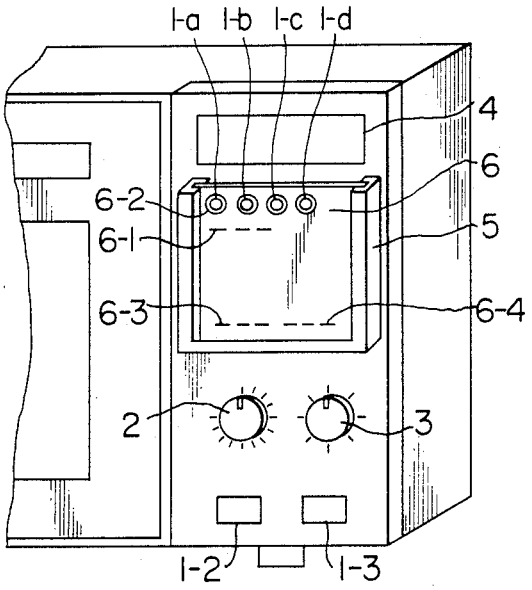
FIG. 3 is a fragmentary schematic perspective view showing one embodiment of the invention.
Figure 4:
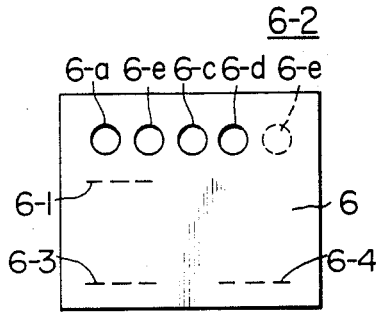
FIG. 4 is a plan view showing an example of a card used in the FIG. 3 embodiment.

Reference will now be made to FIGS. 3 and 4 which illustrate a preferred embodiment of the invention.

In these figures, a set of through holes 6-2 are specifically identified as through holes 6-a through 6-e which may be selectively formed in a cooking card 6 and positioned in association with selected ones of the heating mode selector switches 1-a through 1-e. Actually, however, the through hole 6-e is not formed in this example. Indications 6-3 and 6-4 on the card 6 are representative of standard values of heating time and heating temprature to be set manually by the user. For example, the indication 6-3 suggests "22-minute heating time" and the indication 6-4 "180° C. heating temperature".

In operation, an intended cooking card 6, for example, a cooking card selected for the oven heating mode as shown in FIG. 4 is first inserted into an opened card holder 5 and the card holder 5 is returned as shown in FIG. 3. Since this card is not formed with the through hole 6-e, only the oven heating mode selector switch 1-e is actuated as set forth above.

Next, in accordance with the indication 6-3 on the cooking card 6 which suggests "22-minute heating time", for example, a knob of a variable setter 2 is turned so that values for setting time are displayed on an indicator 4 digitally and sequentially. The user is invited to monitor the display, as mentioned above, for selection of a proper time approximate to 22 minutes. Subsequently, with reference to the indication 6-4 which suggests "180° C. heating temperature", a knob of a variable setter 3 is turned so that the user can also select a proper temperature approximate to 180° C. while monitoring the display on the indicator 4.

As described above, according to this embodiment, the foodstuffs heating apparatus can be materialized which employs the cooking cards carrying indications necessary for handling the manual setters adapted to set the additional heating conditions which cannot be set automatically by means of the cooking cards, so that the user can easily refer to the indications for operation of the setters. Accordingly, the user can be freed from troublesome work of consulting the separate cooking guide for the standard values necessary for manual setting of the heating time, heating temperature and so on, and the procedure for setting the contents of heating can advantageously be simplified.

Another embodiment of the invention will be described with reference to FIGS. 5 and 6. In this embodiment, one of the additional heating condition manual setters is of a rotary type, like the setters shown in FIG. 3, and has a knob 2, but the other is of a lateral slide type and has a laterally movable lever 3-1 in place of the knob 3 shown in FIG. 3. A cooking card according to this embodiment carries information 6-3 and information 6-5 indicative of two additional heating conditions. Since one information 6-3 is numerical, as in the previous embodiment, the user refers to the numerical information and turns the knob 2 of the additional heating condition setter so as to set a value approximate to the numerical information referred to, as in the previous embodiment. However, the other information 6-5 is not numerical information but positional information which can simply be a mark. Setting of the additional heating condition based on this positional information can simply be achieved by sliding the lever 3-1 until it is positioned at the mark.

Figure 6:
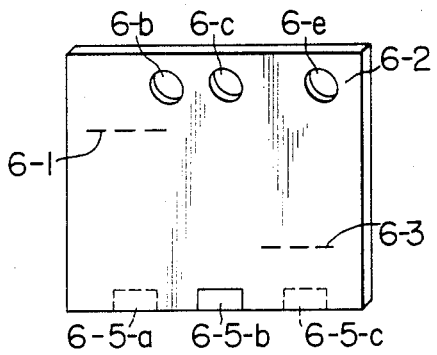
FIG. 6 is a perspective view showing an example of a card used in the FIG. 5 embodiment.
Figure 5:
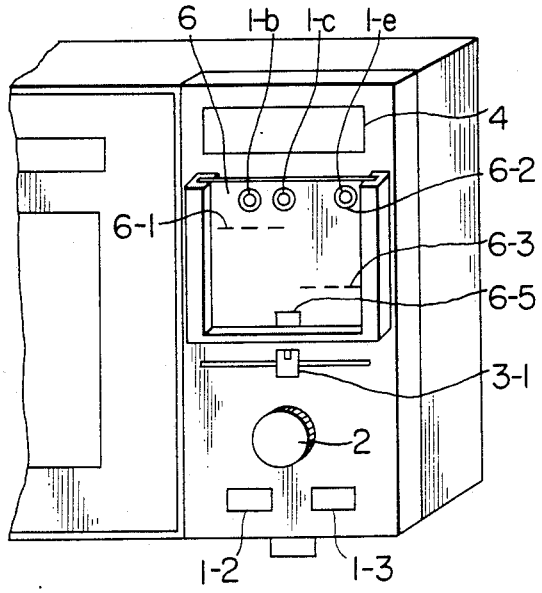
FIG. 5 is a fragmentary schematic perspective view showing another embodiment of the invention.

A cooking card 6 shown in FIGS. 5 and 6 and used in this embodiment for selecting the heating mode is different from the cooking card of the previous embodiment, and has through holes 6-b, 6-c and 6-e. Accordingly, a microwave energy strong heating mode selector switch 1-a and a grill heating mode selector switch 1-d are actuated by this cooking card. When the card 6 is set into the card holder to thereby select the two heating modes, foodstuffs are heated interiorly thereof by microwave energy strong heating and thereafter the surface of the foodstuffs are charred in the course of the grill heating mode. The two selected heating modes are once stored in a control circuit to be described later and the control circuit is responsive to the depression of a heating start button switch 1-3 so as to cause the two selected heating modes to be carried out sequentially in accordance with a predetermined sequence.

In this embodiment, the card 6 specifically carries the information 6-3 which is numerical information for instructing the heating time as the additional heating condition and the information 6-5 which is positional information for instructing the degree of charring. To achieve the heating operation, the microwave energy strong heating is first carried out for the heating time set by the knob 2 and thereafter the heating continues in the grill heating mode until the degree of charring set by the lever 3-1 is realized. An electric circuit having a construction to be described later is adapted to set the degree of charring. It will be appreciated that the information 6-3 carried on the card 6 may be adapted to instruct heating temperature as the additional heating condition, whereby the heating temperature can be set by means of the knob 2. In this case, when temperature of foodstuffs is raised by the microwave energy strong heating to the thus set temperature, the heating mode switches to the grill heating, coming into the charring process.

The charring information mark 6-5 has a fixed width within which the setting of charring is variable so that the degree of charring can be selected within a proper range of charring in accordance with the user's preference. The charring information mark 6-5 is selectively located based on results of experiments on the contents of cooking. Thus, for example, a mark 6-5-a is used for fillets of salmon, a mark 6-5-b for cookie, and a mark 6-5-c for salted mackerel pike.

In operation, an intended cooking card 6, for example a card for cookie as shown in FIG. 6, is selected and set into an opened card holder 5. The card holder 5 is then returned, whereby the two heating modes are selected and an indicator 4 indicates this selection. Since the cooking card 6 carries the information mark 6-5-b indicative of charring, the lever 3-1 for setting the additional heating condition is positioned at the charring information mark 6-5-b. The positioning of the lever may be directed to strong or weak charring within the range determined by the width of the mark 6-5-b in accordance with the user's preference. Thereafter, as in the previous embodiment, foodstuffs are placed in a heating chamber and the heating start switch 1-3 is depressed to perform an intended heating. Since in this embodiment the setter lever has been so positioned as to select a proper degree of charring based on the information mark 6-5 provided on the cooking card 6, the foodstuffs can be charred to the degree which satisfies the user's preference.

As described above, according to this embodiment, it is possible to provide a foodstuffs heating apparatus in which the intensity or degree of charring can be set without fail for each sort of cooking in consideration of the user's preference. Accordingly, failure to char immaturely or excessively can be avoided.

The information mark 6-5 exemplified as the information for setting the charring may of course stand for information for setting another additional heating condition such as a heating temperature or a heating time. In such an alternative, a lever of a heating temperature setter or heating time setter is positioned at this information mark.

Figure 7A:
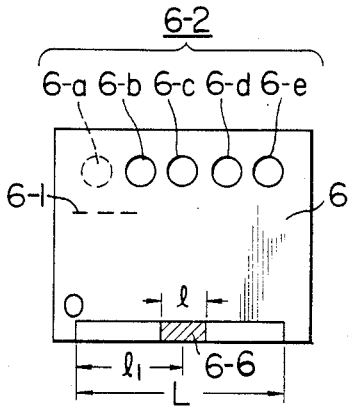
FIGS. 7A, 7B and 8 are plan views showing modified cards.
Figure 7B:
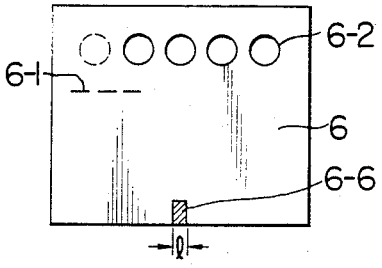

Shown in FIGS. 7A and 7B are modified cards 6 which are suitable for the microwave energy strong heating which lasts for a predetermined time, for example, in order to warm up foodstuffs. With this card 6 providing with no through hole 6-a, the microwave energy strong heating mode can be selected in the same manner as set forth hereinbefore.

The cards 6 of FIGS. 7A and 7B carry an information mark 6-6 for setting the heating time. Specifically, the card 6 of FIG. 7A has a broad lateral width l whereas the card 6 of FIG. 7B has a narrow width. This means that while the FIG. 7B card has little freedom of selection for the heating time setting, the FIG. 7A card has much freedom of the heating time setting. A central portion of the mark may indicate a standard value. It is an option dependent on the user's preference whether the heating tim is set to the standard value or a value under or over the standard value. Provided that the lever for setting the heating time is positioned within the range of this mark, the setting of heating time can be finished without fail. If the information for setting the heating time were indicated on the card as numeral information of standard value to read as, for example, "2 minutes and 40 seconds", for setting a desired value in excess of the standard value by 30 seconds, for example, there would need such a calculation as, 2 minutes and 40 seconds + 30 seconds = 3 minutes and 10 seconds before the setting is carried out. This rather simple mental calculation terribly bothers the user who is usually busy in kitchen working and errors tend to occur. However, since the modified card of this embodiment carries the heating time setting mark 6-6 which is not in terms of numerical information but in terms of positional information, any failure of malsetting of heating time can be avoided, similarly to the previous embodiments.

Figure 8:
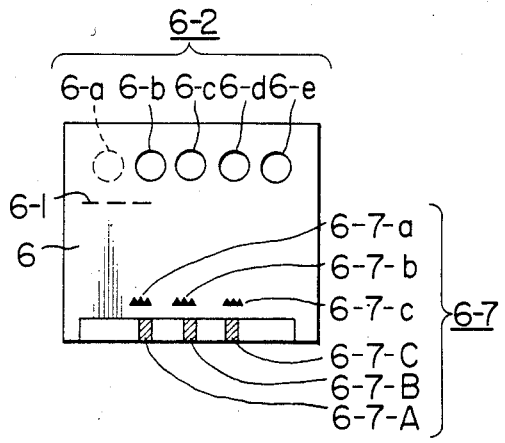

FIG. 8 shows another modified embodiment of a cooking card. This card, like the FIG. 7A or FIG. 7B card, is adapted to select the heating mode of microwave energy strong heating which requires the additional setting of heating time. The card carries information 6-7 for setting the heating time. Even for identical sorts of cooking, the heating time sometimes greatly depends on the mass of an object to be heated. For example, settings of one minute, one minute and fifty seconds, and two minutes and thirty seconds are required for a 100 g mass, a 200 g mass and a 300 g mass of foodstuffs, respectively. Consulting a cooking guide or cooking card for the numerical information and positioning the time setting knob to this numerical information are very troublesome and often result in errors. The card of FIG. 8 carries the time setting information 6-7 consisting of numerical information 6-7-a, 6-7-b and 6-7-c indicative of the mass of foodstuffs and positional information 6-7-A, 6-7-B and 6-7-C indicative of setting times.

In cooking with this modified card 6, the card 6 is set into the card holder 5 and the heating mode of microwave energy strong heating is then selected as has been described hereinbefore. Subsequently, the additional heating condition, i.e., heating time in this case is set. To complete this setting, numerical information (for example, 6-7-a) regarding a mass (for example, 100 g) of foodstuffs to be cooked is retrieved by referring to the card, and the laterally movable lever (not shown) is moved, as in the foregoing embodiments, so as to be positioned at positional information (for example, 6-7-A) directly beneath the retrieved numerical mark with this construction, error in setting the heating time having dependency on the mass of foodstuffs can substantially be avoided.

Figure 9:
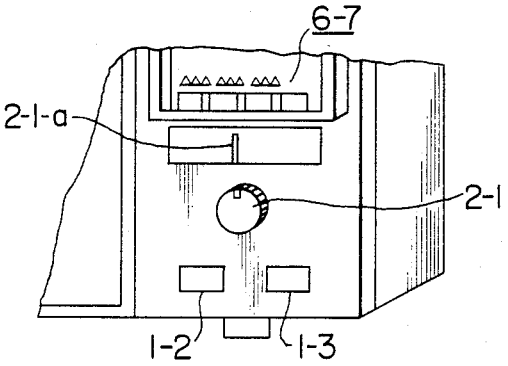
FIG. 9 is a fragmentary schematic perspective view showing still another embodiment of the invention.

FIG. 9 shows a modified additional heating condition setter. In this example, a cooking card of the type as shown in FIG. 8 is selected and set. While the setting of heating time is effected by turning a rotary knob 2-1 similar to that shown in FIG. 1, a pointer 2-1-a which is linked with the rotation of the knob 2-1 for lateral movement is positioned at the positional information in a similar manner to that explained with reference to FIG. 8.

Obviously, this additional heating condition setter, as modified by combining the rotary knob with the pointer, may be applicable to the embodiments previously set forth.

As described above, the additional heating condition setter includes the two knobs 2 and 3 for setting the heating time and the heating temperature in FIGS. 1 to 3, the lever 3-1 for setting the charring and the knob 2 for setting the heating temperature in FIG. 5, and the knob 2-1 for setting the heating time in FIG. 9. Alternatively, however, the setter may include three components for setting the heating time, heating temperature and charring, or the majority of knobs or levers corresponding to the number of additional heating conditions, as desired. Further, the laterally movable lever type setter, which has been used for positioning its lever at the positional information, may obviously be applied, in place of the rotary knob, for setting the numerical information provided on the cooking card.

Figure 10:
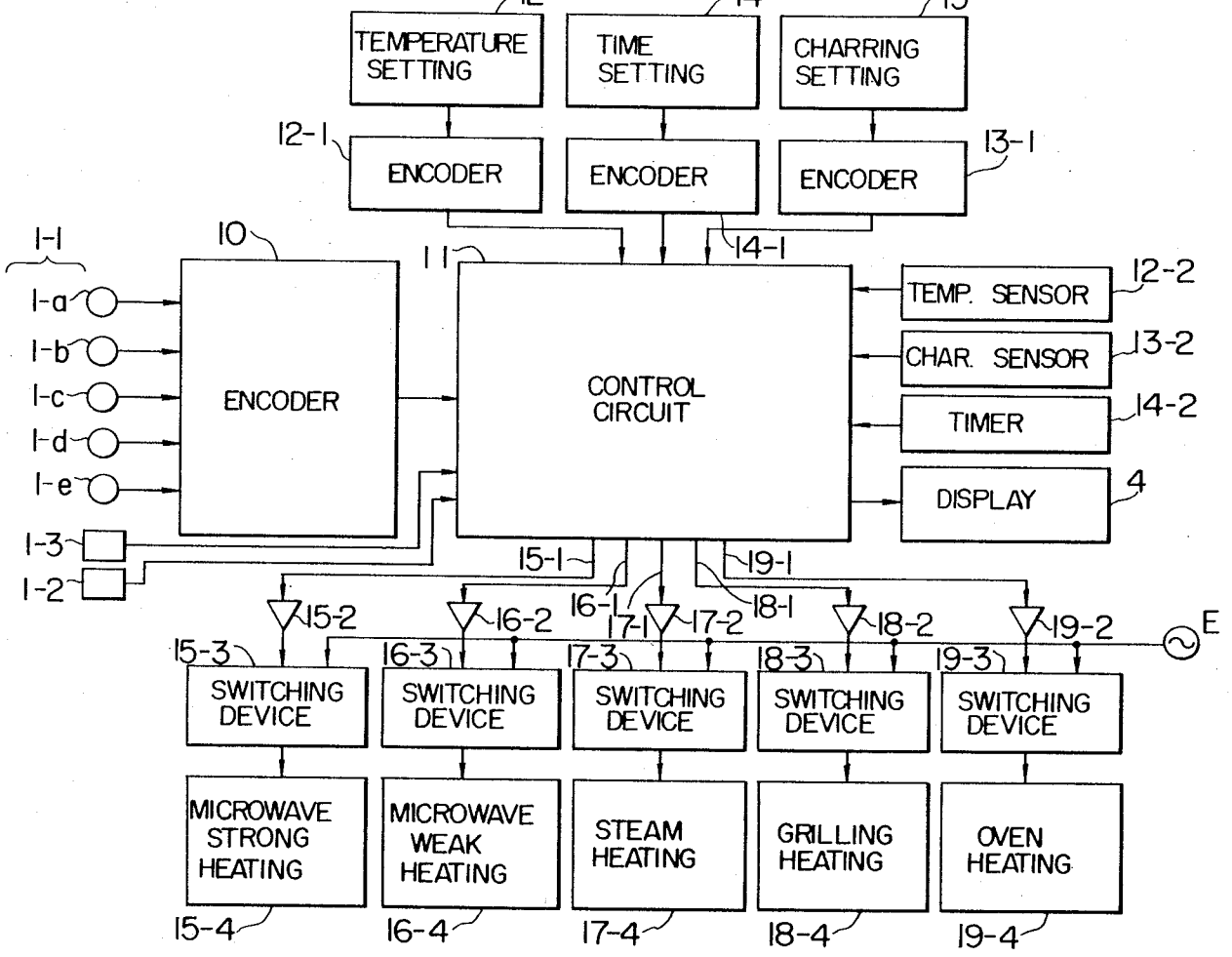
FIG. 10 is a block diagram of an exemplary electric circuit/incorporated in the foregoing embodiments in accordance with the invention.

Turning now to FIG. 10 showing, in the block form, a circuit arrangement adapted for the selection of heating mode and for the setting of additional heating conditions, the flow of control signals appearing in the operation of the circuit arrangement will be described by way of the embodiments of FIGS. 5 and 6. Namely, the cooking card as shown in FIG. 6 is selected and set into the apparatus as shown in FIG. 5. Then, the selector switches 1-a and 1-d are depressed by the card and actuated to send signals to an encoder 10. These signals from the selector switches 1-a and 1-d are converted into binary codes at the encoder 10 and sent to a control circuit 11 to be stored therein. Subsequently, as mentioned above, the knob 2 included in a heating temperature setting unit 12 is adjusted to set the heating temperature in accordance with the numerical information carried on the card. The thus set value is converted into a Gray code at the temperature setting unit 12 and fed to an encoder 12-1. This Gray code is converted into a binary code at the encoder 12-1 and fed to the control circuit 11 to be stored therein. The lever 3-1 included in a charring setting unit 13 is positioned to the positional information 6-5 marked on the card. The thus set value is converted into a Gray code, sent to an encoder 13-1 for conversion into a binary code and fed to the control circuit 11 to be stored therein. The apparatus is now ready for heating operation.

When the start button 1-3 is depressed, the control circuit 11 is caused to actuate the microwave energy strong heating mode to be carried out first between the heating mode and the grill heating mode which have been selected by the card as shown in FIG. 6 in this example and stored in the control circuit. Namely, the control circuit 11 produces an output signal 15-1 which is in turn applied through a buffer 15-2 to a switching device 15-3. The switching device 15-3 is actuated by this output signal 15-1 so as to connect a power source E to a microwave strong heating unit 15-4. The temperature of foodstuffs is detected by a temperature sensor 12-2 included in the heating chamber (not shown) and compared in the control circuit with the temperature setting set by the heating temperature setting unit 12 and stored thereat. When the temperature reaches the set value, the control circuit 11 interrupts the output signal 15-1 and produces another output signal 18-1, so that the microwave strong heating unit 15-4 is switched to a grill heating unit 18-4. Consequently, the grill heating mode starts to operate for charring, in the manner mentioned hereinbefore. The setting of charring, i.e., the determination of the degree of charring is accomplished in the manner mentioned hereinbefore. Specifically, the set value of charring is compared with an output of a charring sensor 13-2 also included in the heating chamber. When the output of the charring sensor 13-2 reaches the set value of charring, the control circuit 11 stops the grill heating unit 18-4 and terminates this cycle of cooking operation. The other heating units 16-4, 17-4 and 19-4 which may be actuated in the same manner by output signals 16-1, 17-1 and 19-1 produced from the control circuit 11 in accordance with the selected by card will not be detailed herein.

In setting the heating time, as in the case of the above temperature and charring settings, the value set in a time setting unit 14 is converted into a binary code by an encoder 14-1 and stored in the control circuit 11. Especially, a timer 14-2 is actuated in response to depression of the start button 1-3. When the timer count reaches the set value, the control circuit 11 stops the heating operation. This timer 14-2 may be separated from the control circuit 11 or alternatively built in the control circuit Il in the form of an electronic circuit. Although not shown in FIG. 10, encoders are provided for converting output signals of the temperature sensor 12-2, the charring sensor 13-2 and the timer 14-2 into binary codes. These encoders may be built in the control circuit 11. Also, the encoders 10, 12-1, 13-1 and 14-1 may obviously be included in the control circuit 11.

In the event that erroneous settings are found prior to depression of the heating start button 1-3, the cancellation button 1-2 is depressed for erasing the stored contents and new correct settings are effected.

Figure 11:
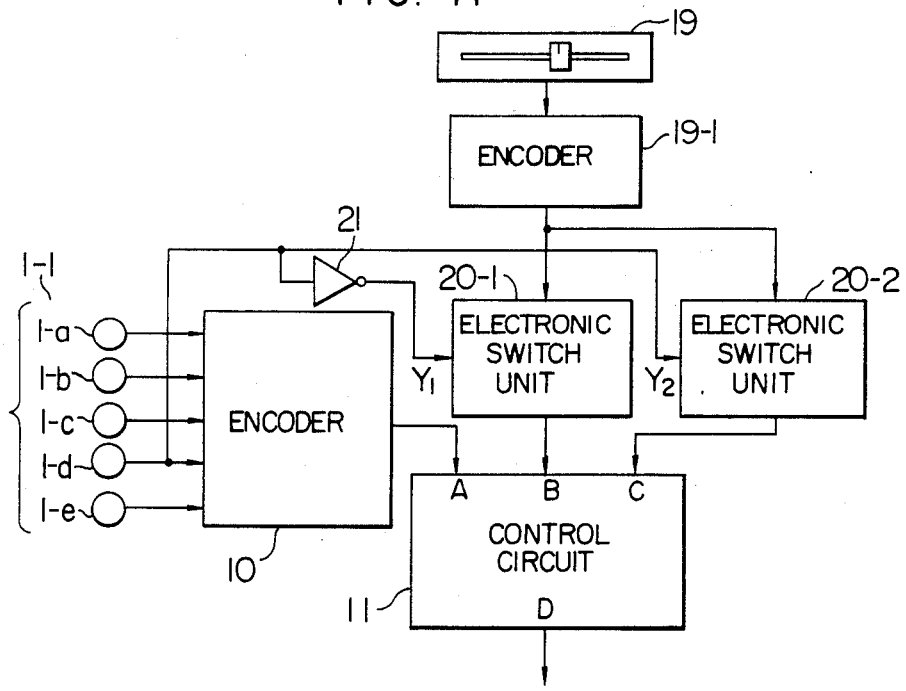
FIG. 11 is a block diagram of an exemplary electric circuit establishing a connection in order for a single setting lever to be adaptive to various additional conditions in common.

In an embodiment as shown in FIG. 11, a single laterally movable lever is adapted to set two additional heating conditions in common. It is assumed that, of three additional heating condition setting units shown in FIG. 10, the time setting unit 14 and charring setting unit 13, for example, are associated with separate upper and lower laterally movable levers (not shown) provided on the operation panel of the heating apparatus and the temperature setting unit 12 is associated with the rotary knob. Thus, the degrees of heating time and charring to be set are given in terms of the positional information whereas the degree of heating temperature is given in terms of the numerical information. The heating time and charring are not set simultaneously in one cycle of cooking. It is then assumed that, for cooking with a cooking card, the heating time is set by the upper lever and for cooking with another cooking card, the charring is set by the lower lever. The upper lever is close to the card and hence it is easy to position this lever at the positional information marked on the card, i.e., the heating temperature setting mark. However, the lower lever is spaced for from the card by way of interposition of the upper lever and hence it is rather difficult to position this lever at the positional information marked on the card, i.e., the charring setting mark. Further, inadvertent misemployment tends to occur between the upper and lower levers, resulting in dangerous errors in setting operation. According to a circuit arrangement of FIG. 11, the single lever can fulfil the functions of the two levers. In the figure, as explained with reference to FIG. 10, a set of heating mode selector switches 1-1 are connected to a heating mode selection signal input terminal A of the control circuit 11 through the encoder 10. An additional heating condition setter 19 is connected through an encoder 19-1 to input terminals of electronic switch units 20-1 and 20-2 which serve as gate circuits. Output terminals of the switch units 20-1 and 20-2 are respectively connected to a heating time setting signal input terminal B and a charring setting signal input terminal C of the control circuit 11. The grill heating mode selector switch 1-d is connected to a control terminal $Y_2$ of the electronic switch unit 20-2 and to a control terminal $Y_1$ of the electronic switch unit 20-1 through an inverter 21. Each of these electronic switch units 20-1 and 20-2 is turned on upon the reception of a logic "1" level signal at its control terminal, and turned off by receiving a logic "0" level signal thereat.

Figure 12A:
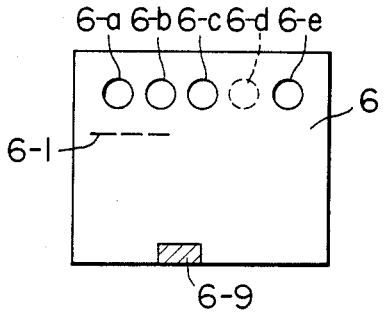
FIGS. 12A and 12B are plan views showing exemplary cards used, in the FIG. 11 circuit.

In operation, an intended cooking card 6, for example, a cooking card as shown in FIG. 12A indicative of the grill heating mode is selected and set into the card holder 5. With this card having no through hole 6-d, only the grill heating mode selector switch 1-d is actuated. Accordingly, the selector switch 1-d of FIG. 11 alone produces a "1" level signal which is converted into a binary code at the encoder 10 and fed to the control circuit 11 through the input terminal A thereof for storage therein of the selected grill heating mode. This "1" level signal is also coupled directly to the control terminal $Y_2$ of the electronic switch unit 20-2 so as to turn the same on, while it is converted into a "0" level signal at the inverter 21 and coupled to the control terminal $Y_1$ of the electronic switch unit 20-1 so as to turn the same off.

When the lever of the additional heating condition setter 19 is positioned to the positional information or a mark 6-1 provided on the cooking card 6 within the width of the mark in accordance with the user's preference, the thus designated digital value is delivered out of the setter 19 in the form of a Gray code, as mentioned hereinbefore. The Gray code is converted into a binary code at the encoder 19-1 and applied to the electronic switch units 20-1 and 20-2. Since only the electronic switch unit 20-2 is turned on, the binary code is transmitted to the control circuit 11 through its charring setting signal input terminal C and stored therein as the charring setting.

Figure 12B:
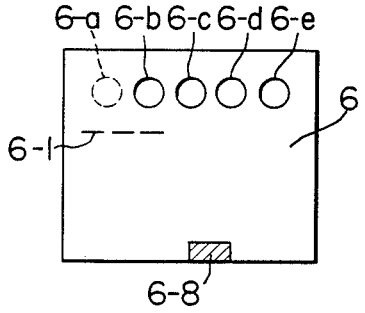

With such a cooking card 6 for the microwave energy strong heating mode as shown in FIG. 12B, only the microwave energy strong heating mode selector switch 1-a is actuated in the same manner as above. Accordingly, the selector switch 1-a of FIG. 11 alone produces a "1" level signal, which is stored as the microwave energy strong heating mode signal in the control circuit 11 in the same manner as above. In this case, however, the selector switch 1-d is not actuated, producing a "0" level signal, so that in contrast to the case of using FIG. 12A card, the electronic switch unit 20-1 is turned on while the electronic switch unit 20-2 is turned off.

Subsequently, when the lever of the additional heating condition setter 19 is positioned at a mark 6-9 of the heating time positional information provided on the card, the thus designated digital value is similarly converted into a binary code at the encoder 19-1 and applied to the electronic switch units 20-1 and 20-2. Since, in this case, only the electronic switch unit 20-1 is turned on, the binary code is transmitted to the control circuit 11 through its heating time signal input terminal B and stored therein as the heating time setting value.

As described above, according to this embodiment, it is possible to provide a foodstuffs heating apparatus which can selectively alternatively effect the heating time setting and charring setting by means of one and the same additional heating condition setter 19 in accordance with the heating mode selected by the card. Accordingly, the user can be freed from troublesome selection and operation of the additional heating condition setter with reference to indication or mark provided on the card and therefore the misemployment of the lever can be avoided, thereby eliminating accidental damage of foodstuffs. Moreover, since this embodiment dispenses with any additional heating condition setters located far away from the cooking card, easy positioning of the lever of the single setter at the positional information mark can advantageously be assured.

Reference is made again to FIG. 7A. The maximum heating time to be set by the heating time setter is determined so as to cover the largest one among the various maximum values determined in compliance with the items of cooking. However, these maximum heating time values determined depending on the items of cooking are considerably different one from another. For example, for boiling foodstuffs, the heating time amounts up to 150 minutes but for warming up foodstuffs, a heating time of about 5 minutes is sufficient.

Accordingly, when the cooking card sets up the microwave energy strong heating mode in order to warm up foodstuffs such as three Chinese buns for which a heating time of about 2 minutes is required, it follows that with the positional information 6-6 provided on the card having a maximum distance L of 75 mm over which the lever of the heating time setter is movable and which corresponds to a maximum variable time of 150 minutes, the center position representative of the standard setting value (2 minutes) of the heating time of this case is displaced from a reference position equivalent to 0 (zero) minute by, $$75 \times \frac{2}{150} = 1 \text{ (mm)}.$$

In other words, when taking the lefthand end of the maximum distance L as the reference point, a distance $l_1$ between the standard setting value position and the reference point is only 1 mm. This results in a disadvantage that when the position to be set by the lever undergoes an extremely slight deviation of 1 mm, the heating time setting becomes erroneous to a great extent. Thus, an embodiment to be described below with reference to FIGS. 13 and 14 is an expedient to solve this problem.

Figure 13:
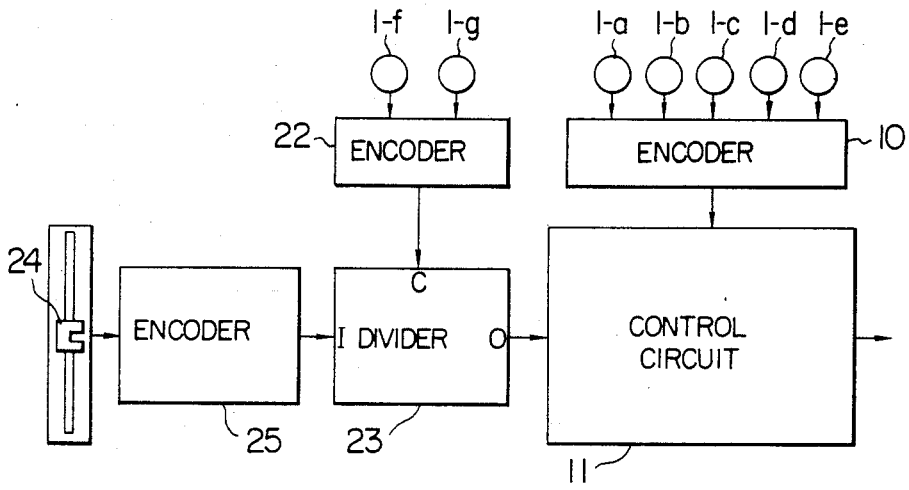
FIG. 13 is a block diagram of an exemplary electric circuit adapted to magnifying the time setting range.
Figure 14:
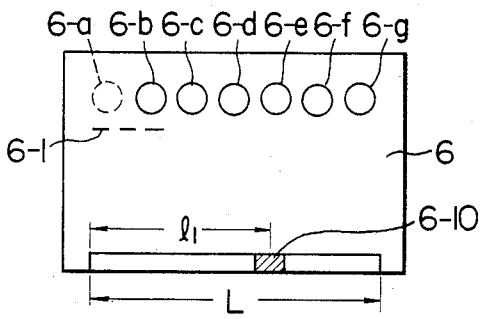
FIG. 14 is a plan view showing an exemplary card used in the FIG. 13 circuit.

FIG. 13 shows a circuit arrangement for materializing this embodiment and FIG. 14 shows an example of a cooking card used for this embodiment. The modified cooking card 6 is designed to have, in addition to through holes 6-a to 6-e which are formed in cards for the previous embodiments and which correspond to selector switches 1-a to 1-e adapted to select various heating modes, through holes 6-f and 6-g corresponding to additional two switches 1-f and 1-g which are arranged in line with the above-mentioned set of selector switches 1-a to 1-e. Specifically, the cooking card 6 as exemplified in FIG. 14 is provided with no through hole 6-a, while having six through holes 6-b to 6-g in total. A positional information mark 6-10 at which a lever 24 is positioned for setting the heating time is provided on the card. Output signals from the heating mode selector switches 1-a to 1-e are coupled, as in the foregoing embodiments, to an encoder 10 to be converted into binary codes and then applied to a control circuit 11. Output signals from the switches 1-f and 1-g, on the other hand, are coupled to an encoder 22 to be converted into binary codes and then applied to a control signal input terminal C of a divider 23. An output signal of the heating time setter 24 is converted into a binary code at an encoder 25 and coupled to an input terminal I of the divider 23. An output terminal O of the divider 23 is coupled to the control circuit 11.

The divider 23 functions to define divisors such as shown in Table 1 below in accordance with the control signals applied to its control signal input terminal C. Each of the switches 1-f and 1-g produces a logic "1" when depressed and a logic "0" when released.

TABLE 1

| Input Control Signal | | |
|---|---|---|
| 1-f | 1-g | Divisor |
| 0 | 0 | 30 |
| | 1 | 10 |

TABLE 1-continued

| Input Control Signal | | |
|---|---|---|
| 1-f | 1-g | Divisor |
| 1 | 0 | 2.5 |
| | 1 | 1 |

With the card formed with the through holes 6-f and 6-g, as shown in FIG. 14, the associated switches 1-g and 1-f are not actuated, producing logics "0" and hence the divisor of the divider is defined as "30" to ensure that a numeral representative of the input signal received by the encoder 25 is divided by 30 and a quotient is applied to the control circuit 11. Consequently, when the maximum movement distance L of the lever 24 is 75 mm and corresponds to the 150-minute maximum heating time with the positional information mark located at the right hand end of the distance L, as exemplified in the foregoing description, the maximum heating time is reduced to $150 \div 30 = 5$ and identified as 5 minutes. In other words, for the card shown in FIG. 14, the maximum movement distance of the lever 24 is so defined in this case as to correspond to 5 minutes at the most. Accordingly, when it is desired to set a heating time of 2 minutes as in the foregoing example, the distance $l_1$ between the reference point and the setting mark is defined as $75 \times 2/5 = 30$ mm. As a result, an erroneous deviation of 1 mm attendent on positioning of the lever 24 can be limited to only 4 seconds.

In the case where a card is formed with the through hole 6-f corresponding to the switch 1-f but provided with no through hole 6-g corresponding to the switch 1-g, the switch 1-g is actuated by the card so that, as will be seen from Table 1, the divisor is defined as "10", thus setting up a maximum setting time which is, $$150 \div 10 = 15 \text{ (min.)}.$$

With a card formed with the through hole 6-g but provided with no through hole 6-f, only the switch 1-f is actuated so that the divisor is defined as "2.5", thus establishing a maximum setting time of $150 \div 2/5 = 60$ (min.). In the case where no through holes 6-f and 6-g are provided, both the switches 1-f and 1-g are actuated to define a divisor of "1", establishing a maximum setting time of 150 minutes. In this manner, it is possible to automatically magnify the setting range of the heating time, thereby preventing erroneous operations even when the set value of heating time is small.

While, in the foregoing embodiments, five heating modes and the corresponding five heating mode selector switches 1-a through 1-e have been described, the number of heating modes may obviously be either larger or less than five, and the number of selector switches may be determined correspondingly.

What is claimed is:

1. A foodstuffs heating apparatus operable selectively in a plurality of different heating modes comprising:

(a) a plurality of different cooking cards;

(b) main information carried by each of said plurality of cooking cards, the main information being information only for instructing to select at least one of said heating modes necessary for a desired cooking designated by the cooking card;

(c) additional information carried by each of said plurality of cooking cards, the additional information being information other than the main information for instructing additional heating conditions determined dependent on the at least one heating mode to be selected in accordance with the main information carried by the card;

(d) card holder means for holding in a predetermined location one of said plurality of cooking cards selected in use;

(e) manual setter means for setting the additional heating conditions in accordance with the additional information carried by the selected cooking card held in said predetermined location; and (f) heating control means for effecting a continuous heating operation of said apparatus only in response to at least both the main information carried by the selected cooking card held in said predetermined location so as to select the at least one heating mode and the additional heating conditions as set by said manual setter means in accordance with the additional information, the continuous heating operation being effected in the selected heating mode in accordance with the set additional heating conditions;

wherein said additional heating conditions include at least one of a heating time, a heating temperature and a charring means comprises a plurality of switch means provided correspondingly to said plurality of heating modes adapted to be actuated for instructing the selection of the corresponding heating modes, control circuit means connected to said switch means, and manually operable heating operation start means connected to said control circuit means; wherein the selected cooking card held in said predetermined location depresses at least one of said plurality of switch means selected to be actuated; wherein said card has through holes formed at positions corresponding to the remaining ones of said plurality of switch means other than said selected switch means to permit the non-actuation of said remaining switch means; and wherein said control circuit means is actuated responsive to the actuation of said heating operation start means to effect the heating operation of said apparatus in one of the heating modes selectively instructed by said at least one of the plurality of switch means actuated by said card in accordance with the additional heating conditions set by said manual setter means.

2. A foodstuffs heating apparatus according to claim 1, wherein said additional information is numerical information described on the card, whereby the setting of said additional heating conditions is effected by said manual setter means based on the reading of said numerical information.

3. A foodstuffs heating apparatus according to claim 2, wherein said manual setter means comprises rotary type indicator means, whereby the setting of said additional heating conditions is effected by placing said rotary indicator means at a rotary position corresponding to said numerical information.

4. A foodstuffs heating apparatus according to claim 2, wherein said manual setter means comprises laterally movable indicator means, whereby the setting of said additional heating conditions is effected by placing said indicator means at a position corresponding to said numerical information.

5. A foodstuffs heating apparatus according to claim 1, wherein said additional heating information is positional information provided on the card, and said manual setter means comprises laterally movable indicator means, whereby the setting of said additional heating conditions is effected by placing said indicator means at a position at which said positional information exists.

6. A foodstuffs heating apparatus according to claim 5, wherein said positional information comprises at least one mark provided on the card, said mark having a predetermined width in the lateral direction determined so that an optionally selective setting range is defined by said width with respect to a central standard setting value.

7. A foodstuffs heating apparatus according to claim 6, wherein said positional information comprises a plurality of marks provided on the card which are alternatively selectively used in accordance with the mass of an object to be heated.

8. A foodstuffs heating apparatus according to claim 1, wherein plural ones of said plurality of switch means are depressed and actuated simultaneously by said card to cause said control circuit means to actuate designated ones of said plurality of heating modes one after one in a predetermined sequence.

9. A foodstuffs heating apparatus according to claim 1, which further comprises charring sensor means for detecting the degree of charring, whereby said control circuit means stops the heating operation in the actuated heating mode when the output of said charring sensor means reaches the charring setting set by said manual setter means.

10. A foodstuffs heating apparatus according to claim 1, which further comprises timing means responsive to the actuation of said heating operation start means to start counting, whereby said control circuit means stops the heating operation in the actuated heating mode when the count of said timing means reaches the heating time setting set by said manual setter means.

11. A foodstuffs heating apparatus according to claim 1, which further comprises temperature sensor means for measuring the temperature of an object to be heated, whereby said control circuit means stops the heating operation in the actuated heating mode when the output of said temperature sensor means reaches the heating temperature setting set by said manual setter means.

12. A foodstuffs heating apparatus according to claim 1, which further comprises means for displaying the heating mode designated by the at least one actuated switch means and the setting set by said manual setter means.

13. A foodstuffs heating apparatus according to claim 1, wherein said control circuit means stores the heating mode designated by said at least one actuated switch means and the additional heating conditions set by said manual setter means, and is responsive to the actuation of said heating operation start means to actuate said designated heating mode so that the heating operation is effected under the setting of said additional heating conditions, and wherein said control means further comprises storage cancelling means for erasing the contents stored in said control circuit means.

14. A foodstuffs heating apparatus according to claim 1, wherein said control means further comprises means for determining whether or not a specified heating mode which requires, as said additional heating conditions, setting of said charring is selected from said plurality of heating modes, so that said determining means applies the value set by said manual setter means, as a charring setting, to said control circuit means when said specified heating mode is selected, or applies the value set by said manual setter means, as a heating time setting, to said control circuit means when one heating mode other than said specified heating mode is selected.

15. A foodstuffs heating apparatus according to claim 14, wherein said determining means comprises first and second gate circuit means each having a first and a second input terminal and an output terminal connected to said control circuit means, said first input terminal of each of said first and second gate circuit means being connected to said manual setter means so as to receive a first signal representative of the value set by said manual setter means, said second input terminal of said first gate circuit means being connected to a specified one of said plurality of switch means corresponding to said specified heating mode so as to receive a second signal representative of the actuation of said specified switch means so that said first gate circuit means applies said first signal to said control circuit means in the presence of said second signal, said second input terminal of said second gate circuit means being connected to said specified switch means through inverter means so that said second gate circuit means applies said first signal to said control circuit means in the absence of said second signal.

16. A foodstuffs heating apparatus according to claim 1, wherein said control means further comprises additional switch means similar to said plurality of switch means, and arithmetic means having a first input terminal connected to said manual setter means, a second input terminal connected to said additional switch means, and an output terminal connected to said control circuit means, said arithmetic means functioning to change the value set by said manual setter means at a predetermined rate when said additional switch means is depressed and actuated by said selected card, so as to apply the changed value, as the additional heating condition setting, to said control circuit means, but not to change the setting set by said manual setter means when said additional switch means is left in its non-actuated status by additional through hole formed in said selected card at a position corresponding to said additional switch means, so as to apply the unchanged setting to said control circuit means, whereby the setting range of said manual setter means is made variable.

17. A foostuffs heating apparatus according to claim 16, wherein said arithmetic means comprises a divider which divides the value set by said manual setter means by a predetermined divisor to produce a resultant quotient when said additional switch means is actuated.

18. A foodstuffs heating apparatus according to claim 14, wherein a plurality of separate and different heating means corresponding to the different heating modes are provided, said manual setter means setting the additional heating conditions in accordance with the additional information which is a type of information different from the main information carried by the cooking cards for selecting at least one heating mode, said heating operation control means being responsive to the selected cooking card for enabling operation of at least one selected different heating means in accordance with the set at least one heating mode and in accordance with the set additional heating conditions.

19. A foodstuffs heating apparatus according to claim 18, wherein the plurality of separate and different heating means include microwave heating means, steam heating means, grilling heating means and oven heating means.

20. A foodstuffs heating apparatus according to claim 18, wherein the plurality of separate and different heating means include at least microwave heating means and steam heating means.

21. A foodstuffs heating apparatus according to claim 18, wherein the plurality of separate and different heating means includes at least microwave heating means and oven heating means.

22. A foodstuffs heating apparatus operable selectively in a plurality of different heating modes comprising:

(a) a plurality of different cooking cards;

(b) main information cards carried by each of said plurality of cooking cards, the main information being information only for instructing to select at least one of said heating modes necessary for a desired cooking designated by the cooking card;

(c) additional information carried by each of said plurality of cooking cards, the additional information being information other than the main information for instructing additional heating conditions determined dependent on the at least one heating mode to be selected in accordance with the main information carried by the card;

(d) card holder means for holding in a predetermined location one of said plurality of cooking cards selected in use;

(e) manual setting means for setting the additional heating conditions in accordance with the additional information carried by the selected cooking card held in said predetermined location, and (f) heating control means for effecting a continuous heating operation of said apparatus only in response to at least both the main information carried by the selected cooking card held in said predetermined location so as to select the at least one heating mode and the additional heating conditions as set by said manual setter means in accordance with the additional information, the continuous heating operation being effected in the selected heating mode in accordance with the set additional heating conditions; wherein said additional heating conditions include at least one of a heating time, a heating temperature and a charring degree of the foodstuffs to be heated;

wherein said additional heating information is positional information provided on the card, and said manual setter means comprises laterally movable indicator means, whereby the setting of said additional heating conditions is effected by placing said indicator means at a position at which said positional information exists; wherein said positional information comprises at least one mark provided on the card, said mark having a predetermined width in the lateral direction determined so that an optionally selective setting range is defined by said width with respect to a central standard setting value.

23. A foodstuffs heating apparatus according to claim 22, wherein said positional information comprises a plurality of marks provided on the card which are alternatively used in accordance with the mass of an object to be heated.

* * * * *